US006155449A

United States Patent [19]

Moriyama

[11] Patent Number: 6,155,449

[45] **Date of Patent: *Dec. 5, 2000**

[54] BREATHER BAG FOR ATMOSPHERIC STORAGE TANK VENT SEAL

[75] Inventor: Alberto Moriyama, Sao Paulo, Brazil

[73] Assignee: Frontenge Engenharia LTDA, Sao Paulo, Brazil

[ * ] Notice: This patent issued on a continued prosecution application filed under 37 CFR 1.53(d), and is subject to the twenty year patent term provisions of 35 U.S.C. 154(a)(2).

[21] Appl. No.: 08/142,430

[22] PCT Filed: Mar. 26, 1993

[86] PCT No.: PCT/BR93/00009

§ 371 Date: Nov. 26, 1993

§ 102(e) Date: Nov. 26, 1993

[87] PCT Pub. No.: WO93/18989

PCT Pub. Date: Sep. 30, 1993

[30] Foreign Application Priority Data

Mar. 26, 1992 [BR] Brazil ..... 9201048

[51] Int. Cl.[7] ..... B65D 88/00

[52] U.S. Cl. ..... 220/565; 220/495.01; 220/495.05

[58] Field of Search ..... 220/403, 410, 220/465, 565, 4.12, 495.01, 495.04, 495.05

[56] References Cited

U.S. PATENT DOCUMENTS

| | | | |
|---|---|---|---|
| 1,709,701 | 4/1929 | Althoff | 220/495.05 |
| 3,215,307 | 11/1965 | Connell | 220/495.01 |
| 3,477,610 | 11/1969 | Hansen | 220/495.01 |
| 3,623,629 | 11/1971 | Hendershot | 220/465 X |
| 4,280,634 | 7/1981 | Wiesenberger et al. | 220/495.05 X |
| 4,457,441 | 7/1984 | McCloughan | 220/4.12 |
| 4,635,814 | 1/1987 | Jones | 220/403 |
| 4,852,765 | 8/1989 | Lyzohub | 220/465 X |
| 5,110,005 | 5/1992 | Schilling | 220/410 X |
| 5,673,664 | 10/1997 | Lassanske | 220/495.05 |

FOREIGN PATENT DOCUMENTS

| | | |
|---|---|---|
| 2454420 | 11/1980 | France . |
| 3209591 | 9/1983 | Germany . |

OTHER PUBLICATIONS

WO, A, 8 404 515 Nov. 11, 1984.
WO, A, 8 501 035 Mar. 14, 1985.

*Primary Examiner*—Steven Pollard
*Attorney, Agent, or Firm*—Pillsbury Madison & Sutro LLP

[57] ABSTRACT

A breather bag for an atmospheric storage tank vent seal includes a bag made with an impermeable and flexible membrane, to be used in storage and/or transportation of liquid product in atmospheric tank, by working as a breather to air vent either in a closed type or an open type tank. Because the stored liquid product in the atmospheric storage tank is kept physically separated from atmospheric air by using the breather bag, the following advantages are obtained. Evaporative losses of liquid products stored in atmospheric tanks are averted. Thus, environmental pollution by product gases that would be expelled out of the tanks is avoided. The entry of flames due to fire in atmospheric storage tanks that contain flammable or combustible liquids is avoided, so that the chances of an accident are reduced. Hydrocontamination of stored liquid product by water present in atmospheric air in atmospheric storage tanks is also avoided. Likewise, contact between the stored liquid product and atmospheric air oxidizing compounds can be avoided. Finally, the entry of extraneous objects into liquid products stored in atmospheric storage tanks like insects and small animals or birds, which may infect the stored liquid products is avoided.

6 Claims, 8 Drawing Sheets

BREATHER BAG FOR ATMOSPHERIC STORAGE TANK VENT SEAL

Figure 1:
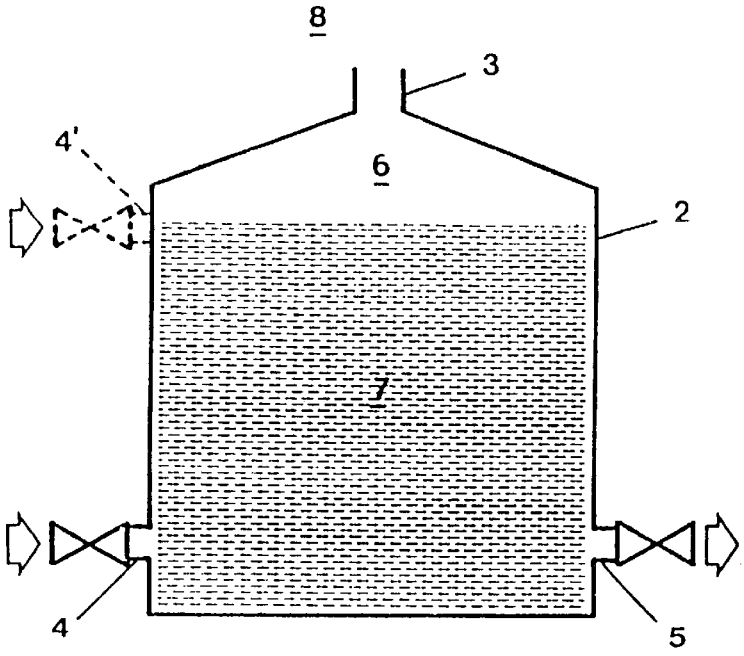
FIGURE 1 PRIOR ART

This application is the national stage of international application PCT/BR93/00009.

The present invention refers to a breather bag made with an impermeable and flexible membrane and with an appropriate shape, for using in open type or closed type tanks for storage and/or transportation of liquid products under atmospheric pressure.

Specifically, the present invention refers to a bag that is produced by use a membrane that, working as a breather in a storage tank, guarantees that the air vent of the storage tank will work normally, without discharacterization of its qualification in storage and/or transportation of liquid products under atmospheric pressure. Additionally, it makes possible the operation of air venting in storage tanks with physical segregation between the stored liquid product and the atmospheric air and environment.

As it is well known, a storage tank is called of atmospheric type when its inner side communicates with the environment (atmosphere) by a free way (air vent hole) and the internal pressure on the tank's wall is equal to its stored liquid column height.

The atmospheric storage tank is called closed type when it communicates with the environment through a top openning (connection or nozzle) named air vent hole. The atmospheric storage tank is called open type when it communicates with environment entirely through the full exposed surface of its stored liquid product.

The air vent of closed type atmospheric storage tanks has the following functions:

To counterbalance the inside vacuum pressure that would be formed in the storage tanks, by allowing the free entry of atmospheric air. This free way entry may be due to a decrease in ambient temperature, that would consequently cause the contraction of air+gases mixture volume contained in the vapor space of the tanks and due to withdrawal operation of liquid product stored in the tanks.

To counterbalance the internal pressure that would be developed inside the storage tanks, with free way blow out of air+gases mixture contained in the vapor space of the tanks through the vent hole, due to increase in ambient temperature (consequently it would occur the expansion of air+gases mixture volume contained in vapor space of the tanks) and due to filling operation of liquid product to store in the tanks.

In this way, the mechanical strenght design calculation of atmospheric storage tanks takes into account only the stress due to height of stored liquid product in the tanks.

The atmospheric storage tanks are commercialy available in a wide range of alternative making forms, as:

a) By geometrical characteristics:
  a1) Closed type, with air vent hole, as:
    Tank;
    Barrel;
    Drum;
    Lidded bucket;
    Bottle;
    Can.
  a2) Open type, with full exposed surface, as
    Pool;
    Basin;
    Lidness bucket;
    Open box.
b) By installation and using type:
  b1) Fixed mounted pattern, as:

Outdoor;
    Indoor;
    Burried (underground).
  b2) Mobile mounted pattern, as:
    Part of engine system and/or aggregated to carrying vehicle, for:
      Road way transport (as car);
      Rail way transport (as train);
      Water way transport (as ship);
      Air way transport (as aircraft).
    Shaped for handling and transportation (as container);
    Skid-mounted type.

The atmospheric storage tanks are normally used for storing liquid products of several natures, as:

Water;

Waste disposals (effluents and sewers);

Chemical products;

Petroleum and derivated products;

Vegetable origin extracts;

Animal origin extracts;

Slurries of mineral processing.

The liquid products to be stored in atmospheric tanks may present some characteristics, with specific applicable requirements concerning to products quality protection and safeguard procedure to be observed in each case, such as:

Combustible and/or flammable property;

Chemical activity;

Sanitary quality;

Higroscopic property;

Odor, harmful to health and/or comfort of the people.

The liquid product is naturally exposed to evaporation change when gases take away from the liquid-gases separation surface. These gases are expelled out through the air vent to the environment. This normally occurs for a dead state, specially during the product filling operation of atmospheric tank, by causing serious inconveniences like:

Environment pollution;

Fire and explosion hazard;

Evaporation loss;

Corrosion attack on neighbouring construction and structures.

The atmospheric air that enters into the storage tanks through the vent hole, which contains water vapours in its composition, may cause several other problems, such as:

Change in quality specification of hygroscopic products;

Water condensation in the vapor space of tank what will cause:
  Formation of water pocket in liquid product;
  Water emulsion in stored liquid product.

The communication between existent storage tanks and the environment by a free way through vent hole, allows the entry into tank of insets, small animals or birds. These small creatures, when confined inside the tanks, may contaminate stored liquid product either by their excrement either by its putrefaction. In this case, if there is sanitary requirement to the liquid product, it may be prejudged forbidden to use for consumption in food or pharmaceutical industry.

The document PCT number WO 84/04515, (Nov. 22, 1984), METHOD AND DEVICE FOR PERMANENTLY STORING LIQUIDS PARTICULARLY VOLATILE LIQUIDS INTO CONTAINERS CLOSED UNDER ATMOSPHERIC PRESSURE, explains a process and a device that is applicable only to volatile liquids storage tanks, characterized by stored product with constant mass, under atmospheric pressure, just in closed type storage systems . The purpose of these devices is the elimination of products losses that occur through the tank's vent hole, because of either liquid product evaporation or its volume change, this last one caused by product thermal variation.

The following points can be noted in the referenced document:

The operation mode of presented device needs aid of many operating accessories, and it depends on operators works in pressurization and depressurization steps.

The presented device with internal pressure control valve, makes it slightly pressurized tank, what descontinues it as an atmospheric tank.

The presented device keeps vapor space of the storage tank hermetically closed; internal pressure change due to thermal variation of stored liquid product in the tank is relieved to a plastic bag piece; the pressure of this bag piece is relieved to environment through a pressure control valve.

In presented device, when plastic piece will be installed in the tank, the last one is kept full charged of liquid product at its useful volume, and the first one is installed at tank vapor space.

There is water condensation at inner side of plastic piece, due to atmospheric air containing water vapour that is introduced and kept in the bag, because this one is hermetically closed and does not allow water vapours blow out of bag. In this way, the presented device needs a piping system with a suction valve to purge out condensed water from de inner side of the plastic piece.

Another PCT document, from same depositor, number WO 85/01035, (Mar. 14, 1985), PROCESS AND DEVICE FOR ELIMINATING LOSSES DUE TO THE FILLING AND VAPOR EVOLUTION IN THE CASE OF VOLATILE SUBSTANCES STORED IN HORIZONTAL CYLINDRICAL TANKS, explains a process and a device with specific application in cylindrical horizontal tanks, whose purpose is to eliminate the evaporation losses of stored products through the vent hole, during tank filling operation and by natural evaporation.

Like in the earlier document, this device is also applicable specifically in storage tanks for volatile liquid products only and, so that, the presented process has a pressurization and depressurization system too. The presented device is a plastic piece like a bag, hermetically closed inside the tank, attached to a blind flange at a top connection of tank and joined to pressurization and depressurization piping system. It has also in the tanks other internal parts.

This plastic piece, as explained, is inflated into full charged tank by using a gaseous material. Before its installation the vapor space of tank is blanked using Halon gas. The normal operation of this presented device depends on low pressure nitrogen gas in the bag.

As noted in the first device, inside the plastic piece of presented device, condensation of water vapours from atmospheric air will also occur. The presence of atmospheric air is due to its entry in the bag during operation. To purge out the condensed water it is needed a suction valve connected to a piping system.

By the other hand, the existing inner casing pipe allows evaporation of a small fraction of stored liquid proportional to its sectional area. Consequently this device efficiency cannot be considered as 100% for killing liquid product evaporation loss.

In summary, it is possible to assert that process and devices exposed in PCT's documents numbers WO 84/04515 and WO 85/01035 present inconveniences as follows:

They consume energy and raw materials (gases);

Operational vigilance is needed when tank is storing product;

The system requires frequent maintenance works;

The system start-up is very hard and laborious;

The purpose is only to eliminate evaporation losses of liquid products stored in atmospheric tanks.

Therefore, the most important goal of this present invention is to give a way to solve definitively above listed problems and inconveniences.

Another objective of this present invention is to provide a way to give not only a definitive solution for above listed difficulties by avoiding evaporation losses of liquid products stored in atmospheric tank but also a way to avoid liquid product contamination due to entry of atmospheric air into tank and consequent exposition of liquid product to atmospheric air.

Also, another objective of this present invention is to provide a way to eliminate evaporation losses and contamination of liquid products stored in atmospheric tanks, applicable either to CLOSED TYPE TANKS and to OPEN TYPE TANKS.

The above listed and another goals may be reached by using this present invention BREATHER BAG FOR ATMOSPHERIC STORAGE TANK VENT SEAL, that has as principal characteristics the following points:

1$^{st}$) The breather bag allows normal air vent operation in atmospheric storage tanks with full segregation between stored liquid product and atmospheric air.

2$^{nd}$) The breather bag maintains atmospheric qualification of storage tanks in mechanical design procedures.

Figure 2:
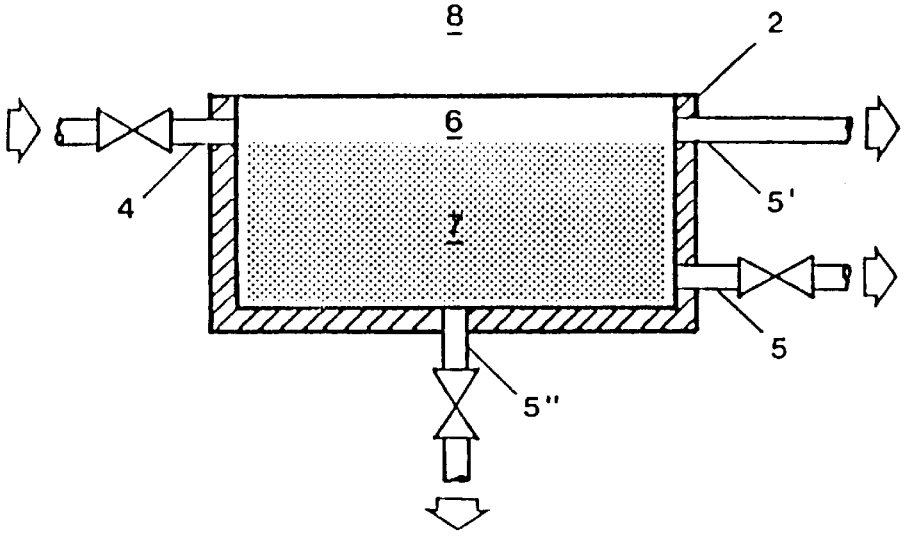
FIGURE 2 PRIOR ART
Figure 3:
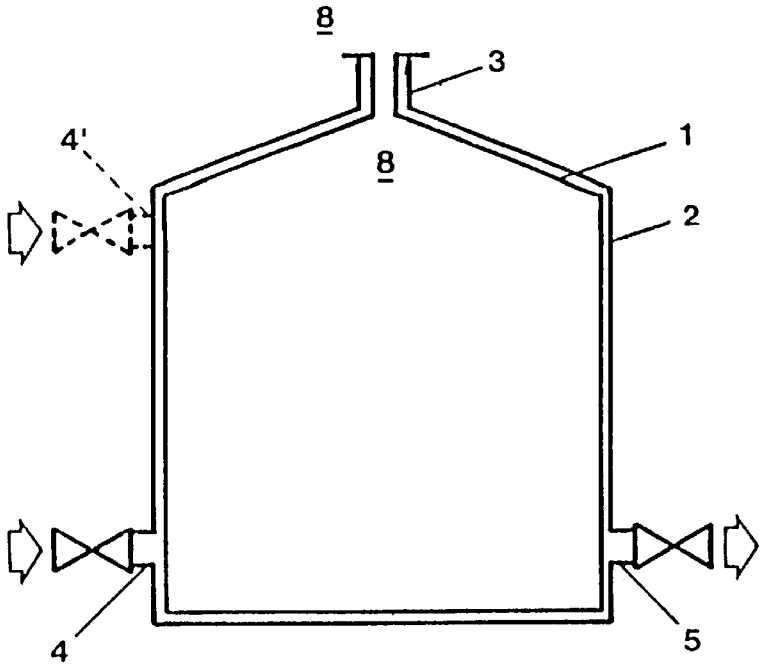
Figure 4:
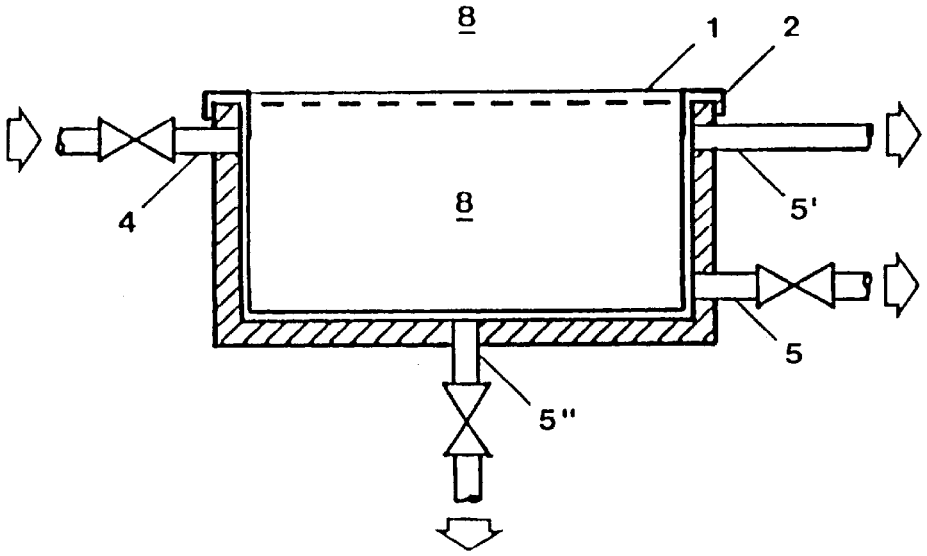
Figure 11:
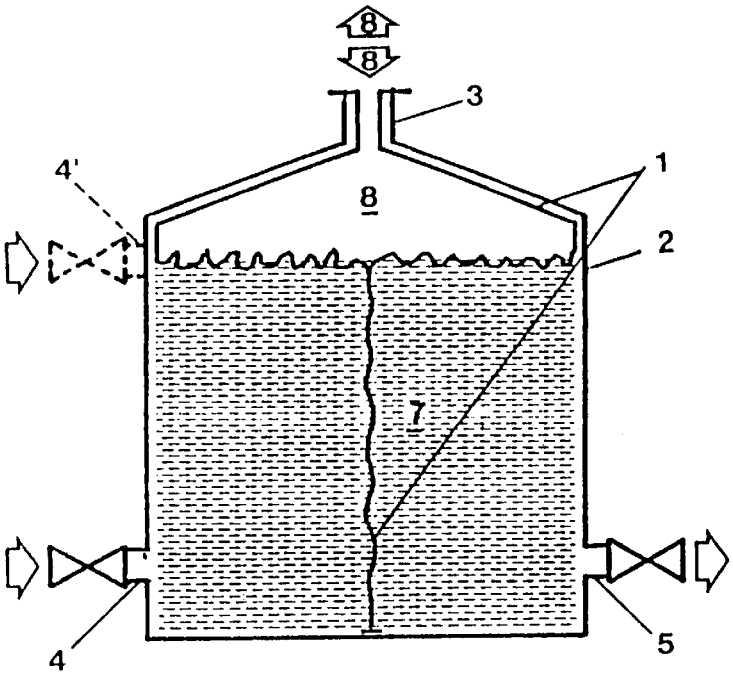
Figure 12:
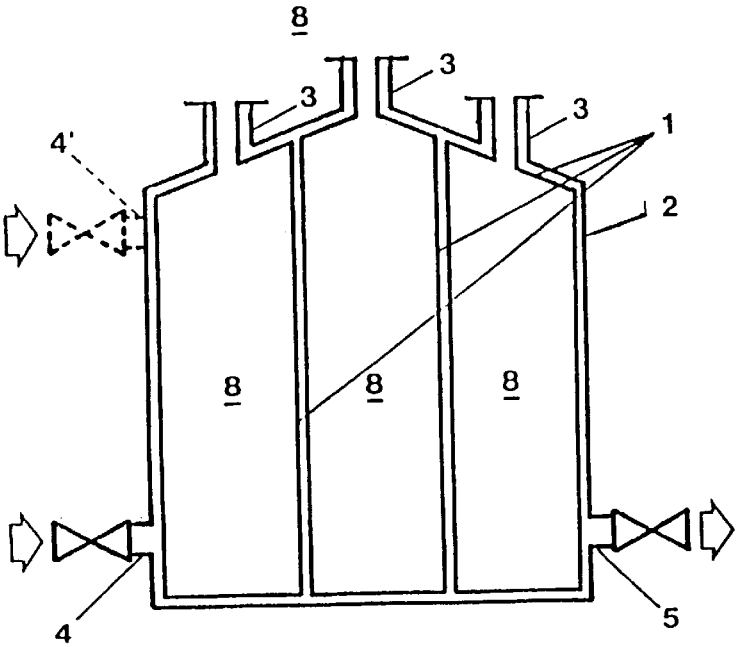

The schematic figures attached in this document make possible a better explanation about objectives of the present invention, BREATHER BAG FOR ATMOSPHERIC STORAGE TANK VENT SEAL. Bellow, in this document are reported schematic figures that show the invention idea's shapes:

FIG. 1: sketch drawing of an atmospheric closed type storage tank;

FIG. 2: sketch drawing of an atmospheric open type storage tank;

FIG. 3: sketch drawing of an atmospheric closed type storage tank with present invention breather bag already installed;

FIG. 4: sketch drawing of an atmospheric open type storage tank with present invention breather bag already installed;

FIGS. 5, 6, 7, 8, 9, and 10: sketch drawings showing operating steps for this present invention breather bag intalled in atmospheric closed type storage tank;

FIGS. 11 and 12: sketch drawings showing two other alternative forms for installing this present invention breather bag in atmospheric closed type storage tank;

FIGS. 13, 14, 15 and 16: sketch drawings showing operating steps for this present invention breather bag installed in atmospheric open type storage tank.

NOTE: In attached figures same reference numbers identify similar elements.

In accordance to FIG. 1, a standard atmospheric closed type vertical storage tank (2) has the following parts: on the top an air vent nozzle (3); liquid product inlet nozzle (4) or (4'); stored liquid product (7) outlet nozzle (5). When the atmospheric storage tank is charged with stored liquid product (7), in upper portion inside the tank above product level it is formed a region named vapor-space (6) that contains a mixture of atmospheric air+product vapours. The portion outside air vent nozzle (3) is environment atmospheric air (8).

In accordance to FIG. 2, an atmospheric open type storage tank (2) is presented with the same parts of a standard atmospheric closed type vertical storage tank (2), but without air vent nozzle (3). It is also showing two more outlet connection nozzles: to liquid product overflow (5') with a non-return check valve in piping system and to liquid product drain (5").

Either the inlet nozzle (4) or the outlet nozzle (5) may be attached block valves for controlling liquid products flow in piping system.

Otherwise, as showed in FIGS. 3 and 4 present invention breather bag for sealed vent of atmospheric storage tanks is a compartment or bag (1), made with an impermeable and flexible membrane with shape and dimensions near to inner geometry form of atmospheric storage tank (2) with thin wall thickness sufficient only to support a low magnitude positive pressure or vacuum and a minimum resistence to mechanical deformations, but with chemical corrosion resistence for operating stored liquid product (7).

In atmospheric closed type storage tank (2) totally empty of liquid product (7) breather bag is introduced into tank (2) and fastened to the conventional existing air vent nozzle (3). At next step atmospheric air (8) is blowed into breather bag (1) while the internal air (6) of tank is purged out. This operation may be performed with inlet connection (4) block valve in closed position and outlet connection (5) block valve in open position, so that atmospheric air (8) is blowed into breather bag (1) through air vent nozzle (3).

In atmospheric open type storage tank (2) breather bag (1) is installed flush to tank's internal walls and fastened at walls top side.

During liquid product (7) filling operation into storage tank (2) atmospheric air (8) which was inicially blowed into breather bag (1) is now breathed out to environment without presence of stored product vapours. This process may occcur because breather bag (1) is made with an impermeable membrane that becomes a physical barrier between stored liquid product (7) and breather bag (1) internal atmospheric air (8).

During withdrawal operation of stored liquid product (7) from storage tank (2), atmospheric air (8) enters into breather bag (1) through air vent nozzle (3) and it is kept segregated from stored liquid product (7).

The FIGS. 5 to 10 show the sequence of operation steps of this present invention breather bag (1) when it is installed in atmospheric closed type storage tank (2).

BREATHER BAG INSTALLATION

The breather bag (1), made with dimensions previously defined for each case, taking into account its geometrical particularities for each application, is introduced empty into non charged atmospheric storage tank (2) through air vent nozzle (3).

Figure 5:
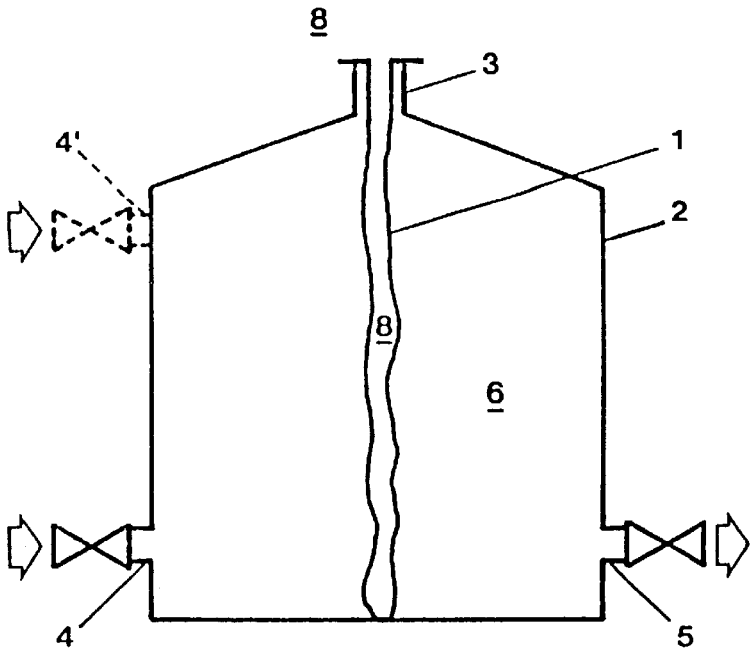

The FIG. 5 shows an empty breather bag (1) in a non charged atmospheric closed type storage tank (2).

The breather bag (1) must be fixed by a convenient way at air vent nozzle (3) so that this operation step will be responsible for tightness from interior of atmospheric storage tank (2) to environment.

ATMOSPHERIC AIR BLOWING INTO BREATHER BAG

The empty breather bag (1) inicially introduced into non charged atmospheric closed type storage tank (2) is then inflated with atmospheric air (8).

Figure 6:
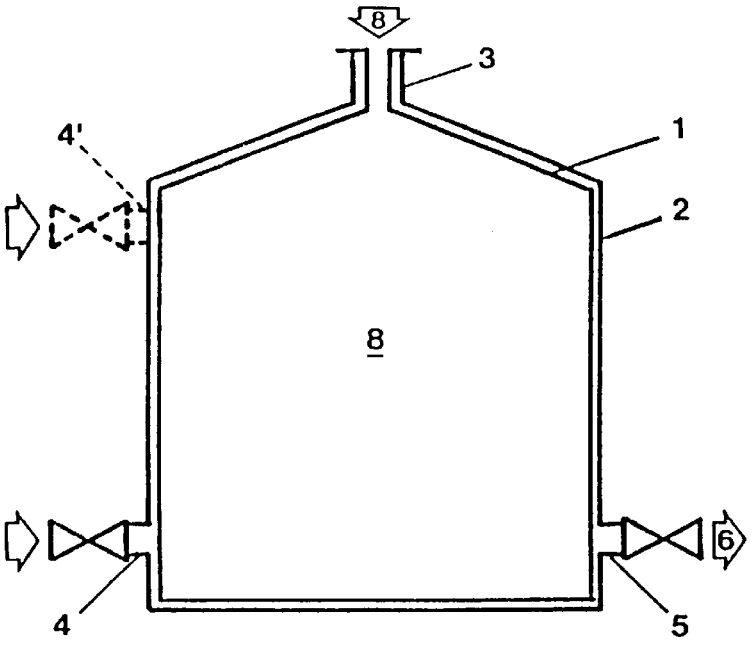

The FIG. 6 shows inflated breather bag (1) in the non charged atmospheric closed type storage tank (2).

The steps for inflating empty breather bag (1) with atmospheric air (8) are:

1st) The inlet nozzle (4) block valve is kept in closed position;

2nd) The outlet nozzle (5) block valve is kept in open position to allow exhaust of air (6) initially contained inside the atmospheric closed type storage tank (2).

3rd) The atmospheric air (8) is blowed into the empty breather bag (1) aided by an external atmospheric air (8) source or by an air blower equipment.

4th) The outlet nozzle (5) block will be closed when breather bag (1) becomes fully inflated with atmospheric air (8), so that the breather bag (1) will be joined to internal wall of the atmospheric closed type storage tank (2).

ATMOSPHERIC CLOSED TYPE STORAGE TANK (2) FILLING OPERATION

The storing liquid product (7) is fed into atmospheric closed type storage tank (2) through inlet nozzle (4 or 4') with its block valve in open position.

Figure 7:
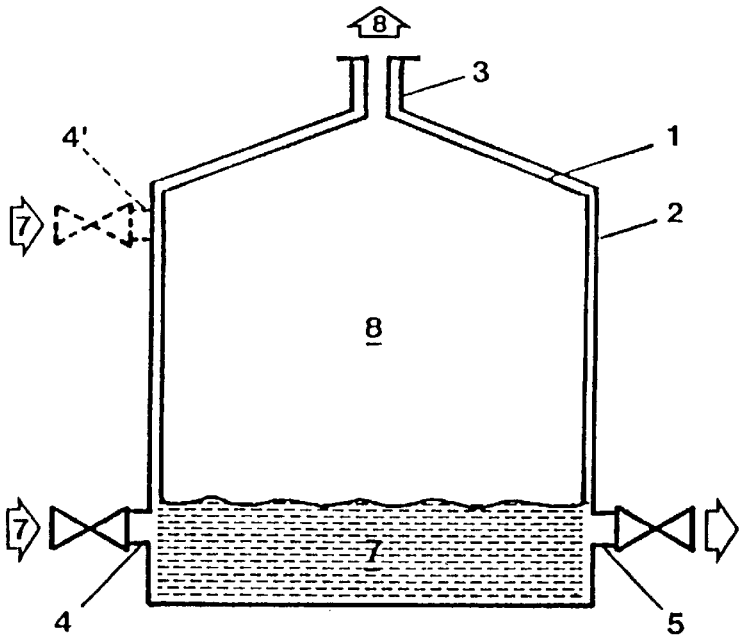

The FIG. 7 shows the liquid product (7) filling operation in atmospheric closed type storage tank (2).

While liquid product (7) enters into atmospheric closed type storage tank (2), atmospheric air (8) inside the breather bag (1) is turned out to environment through vent nozzle (3). The exit of atmospheric air (8) from breather bag (1) do not permit that atmospheric closed type storage tank (2) becomes pressurized unless by strenght due to storage liquid product (7) column height.

In this operation step, it can be noted that stored liquid product (7) is segregated from atmospheric air (8). As breather bag membrane is in direct contact with stored liquid product (7) surface, evaporation change of liquid product (7) will be avoided.

ATMOSPHERIC CLOSED TYPE STORAGE TANK (2) HIGH LEVEL

When storage tank high level line is reached by liquid product (7), feed of liquid product (7) through inlet nozzle (4 or 4') is stopped.

Figure 8:
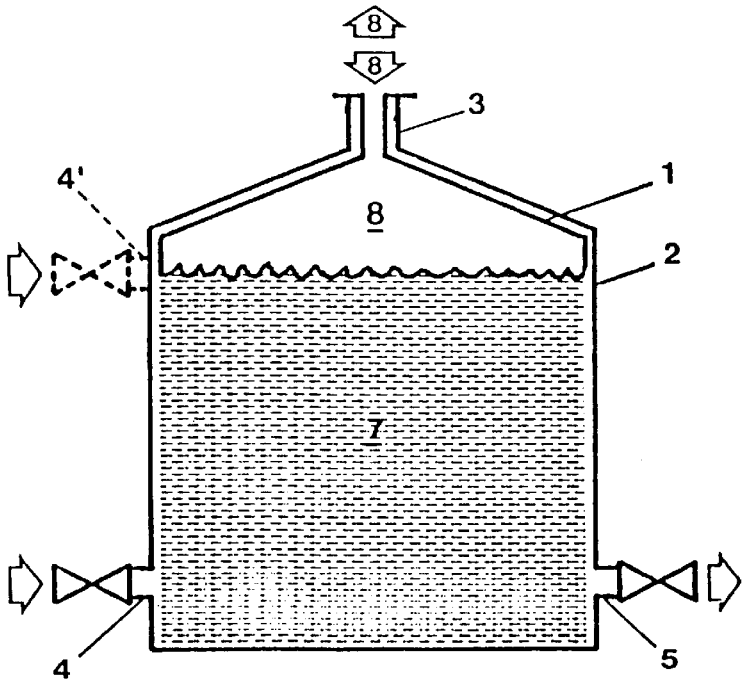

The FIG. 8 shows atmospheric closed type storage tank (2) full charged with liquid product (7) up to storage high level line.

The breather bag (1) will be empty, without atmospheric air (8) and it will be drawn up in the tank vapor space or it will be crushed in the liquid product (7). At this step it is observed that:

1st) The stored liquid product (7) is segregated from atmospheric air (8);

2nd) The stored liquid product (7) changes due to evaporation will be avoided;

3rd) Any volume variation of stored liquid product (7) in atmospheric closed type storage tank (2) due to changes in temperature either in tank or in environment will be absorbed by breather bag (1);

4th) Any extraneous objects that would be introduced through the air vent nozzle (3) into tank (2) will be kept inside the tank (2) physically segregated from stored liquid product (7) by breather bag membrane (1).

ATMOSPHERIC CLOSED TYPE STORAGE TANK (2) EMPTYING OPERATION

The emptying operation of atmospheric closed type storage tank (2) occurs by stored liquid product (7) withdrawal through outlet nozzle (5) with outlet nozzle (5) block valve kept in open position.

Figure 9:
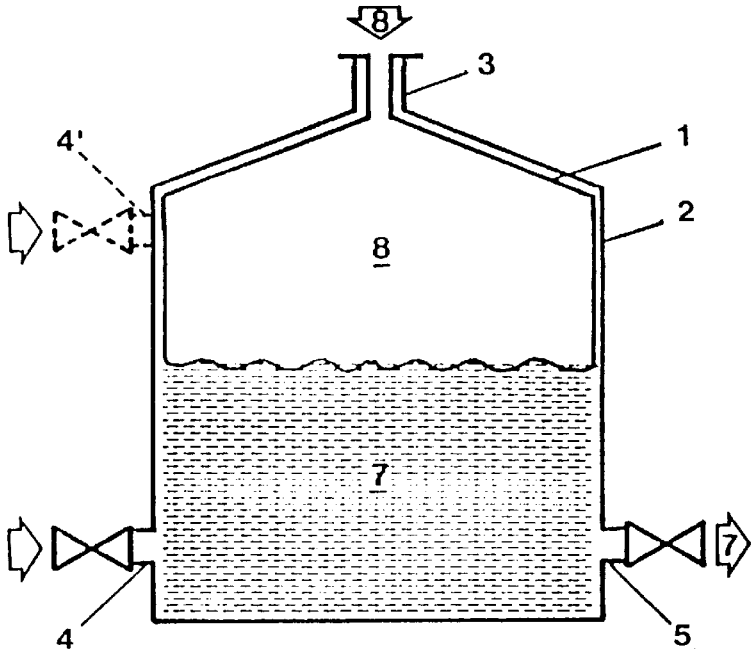

The FIG. 9 shows emptying operation of atmospheric closed type storage tank (2) with stored liquid product (7) withdrawal through outlet nozzle (5).

The vacuum that would be formed inside atmospheric closed type storage tank (2) due to stored liquid product (7) withdrawal, is promptly counterbalanced by atmospheric air (8) entering into breather bag (1). Thus in atmospheric closed type storage tank (2) it will be avoided possibility to failure.

In this step it is denoted that, atmospheric air (8), introduced into tank (2) to counterbalance stored liquid product (7) withdrawal, will be kept inside breather bag (1) and segregated from stored liquid product (7). This is the warranty that stored liquid product (7) will be free either of contamination or of changes in its specification quality what would occur due to presence of atmospheric air (8) either with water vapours or with oxidizing compounds.

ATMOSPHERIC CLOSED TYPE STORAGE TANK (2) LOW LEVEL

When storage tank (2) low level line is reached by liquid product (7) withdrawal operation is stopped. All atmospheric air (8) introduced to counterbalance atmospheric closed type storage tank (2) emptying operation with liquid product (7) withdrawal is kept inside the breather bag (1) and segregated from stored liquid product (7).

Figure 10:
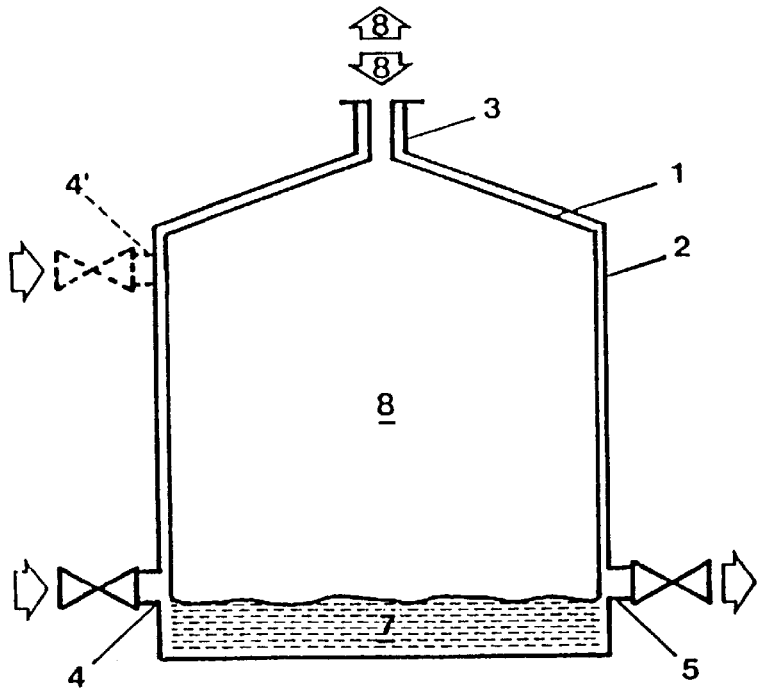

The FIG. 10 shows stored liquid product (7) at low level line of atmospheric closed type storage tank (2).

To remove breather bag (1) from atmospheric storage tank (2) it is needed to introduce atmospheric air (8) between breather bag (1) and inner side wall of atmospheric storage tank (2). The atmospheric air (8) exhaust operation in the breather bag (1) is done by introducing a new air into the atmospheric storage tank (2) through inlet nozzle (4 or 4') while outlet nozzle (5) block valve is maintained in closed position.

The FIGS. 11 and 12 show other two alternative forms to install present invention breather bag (1) atmospheric closed type storage tank (2).

These figures present the following:

FIG. 11: Tank bottom attached breather bag (1);

FIG. 12: Multiplex breather bag (1).

BOTTOM ATTACHED BREATHER BAG (1)

During stored liquid product (7) withdrawal operation of atmospheric storage tank (2) either closed type or open type it may occur possibility of breather bag (1) to cling at the atmospheric storage tank (2) inner side wall. So breather bag (1) lower part may be fixed at the bottom of atmospheric storage tank (2) by adequate aids.

The FIG. 11 shows breather bag (1) crushed into stored liquid product (7) with its lower part fixed at the bottom of atmospheric closed type storage tank (2).

In this case, it is denoted that at atmospheric storage tank (2) filling operation breather bag (1) will not float, but it will be crushed into stored liquid product (7) without disadvantage neither to operation nor to durability. Therefore, during stored liquid product (7) withdrawal operation, possibility of breather bag (1) clinging at inner side wall of storage tank (2) will be avoided.

MULTIPLEX BREATHER BAG (1) APPLICATION

More of one breather bag (1) may be used in atmospheric storage tank (2) either closed type or open type.

The FIG. 12 shows application of various breather bags (1) in an atmospheric closed type storage tank (2).

Use of multiplex breather bag (1) is recommended in following cases:

1st) The atmospheric storage tank (2) has dimensions too large for using a simplex breather bag (1);

2nd) The atmospheric storage tank (2) has internal parts which may perturb the simplex breather bag (1) sound working.

At last, FIGS. 13 to 16 show present invention breather bag (1) operation steps when it is applied in atmospheric open type storage tank (2).

Figure 13:
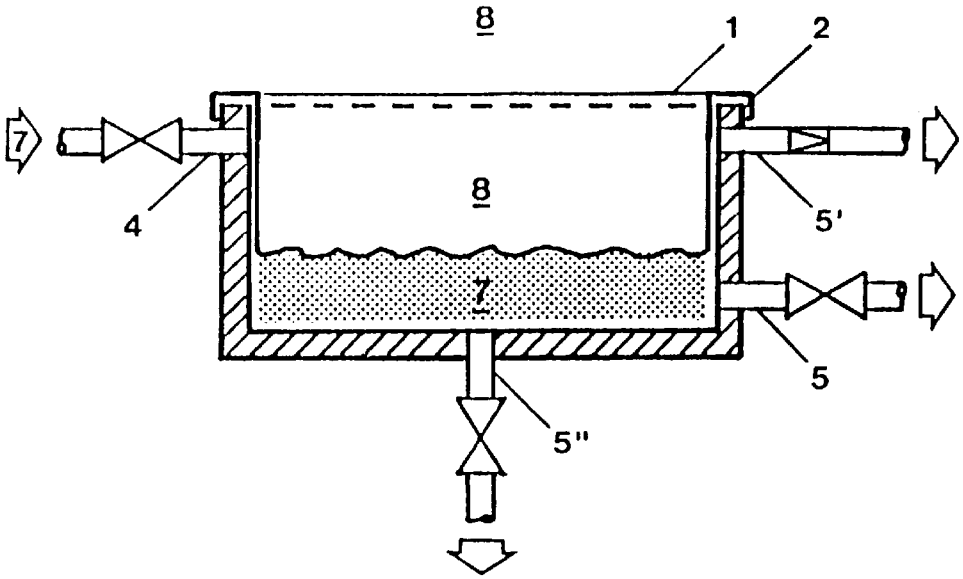
Figure 14:
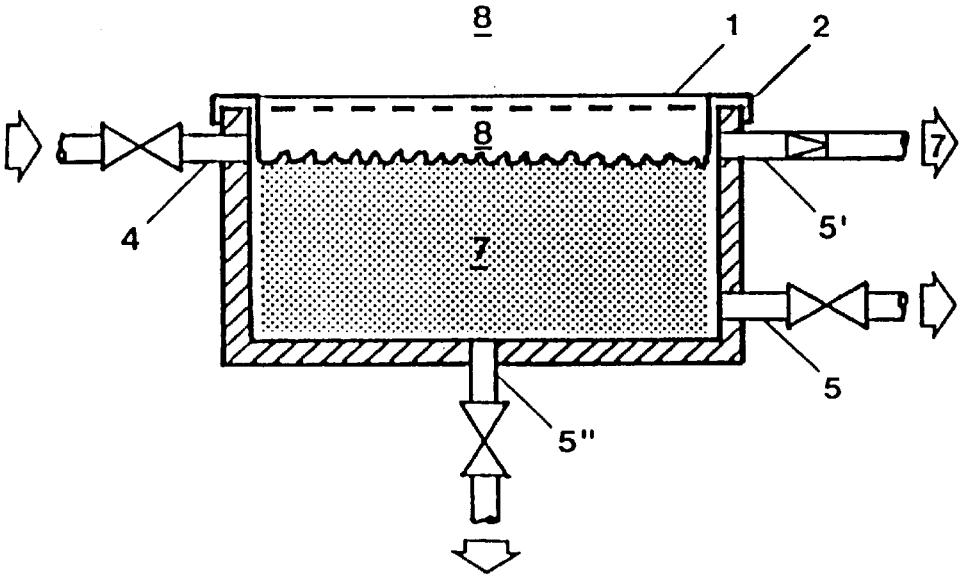
Figure 15:
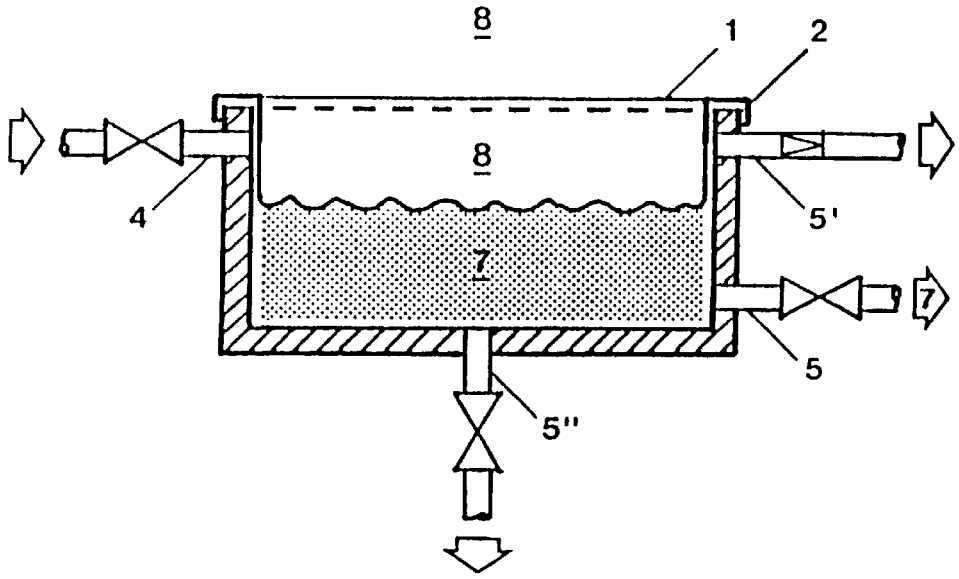
Figure 16:
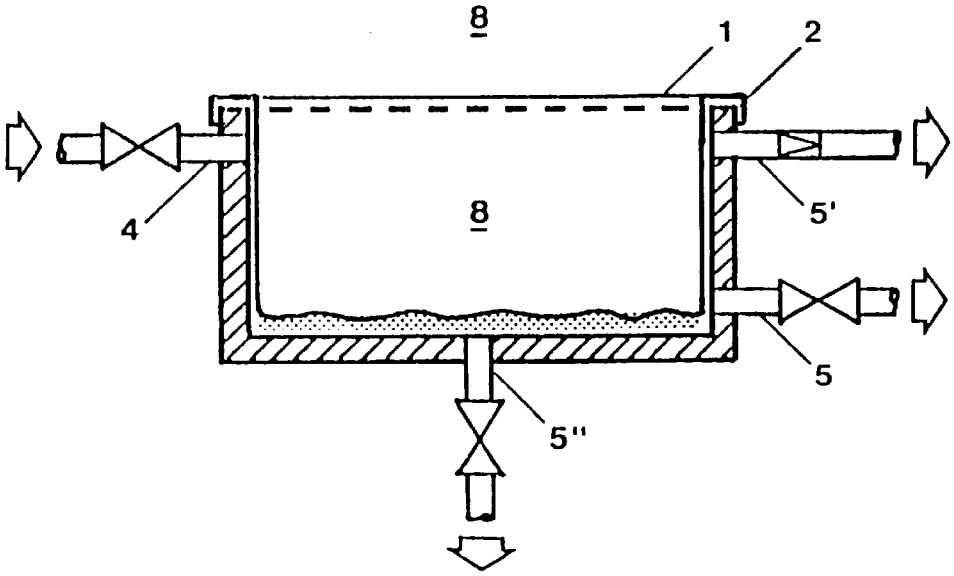

These figures show the following:

FIG. 13: Atmospheric open type storage tank (2) filling operation;

FIG. 14: Atmospheric open type storage tank (2) high level;

FIG. 15: Atmospheric open type storage tank (2) emptying operation;

FIG. 16: Atmospheric open type storage tank (2) low level.

ATMOSPHERIC OPEN TYPE STORAGE TANK (2) FILLING OPERATION

The storing liquid product (7) is fed into atmospheric open type storage tank (2) through inlet nozzle (4) with its block valve kept in open position.

The FIG. 13 shows atmospheric open type storage tank (2) filling operation through inlet nozzle (4) feeding liquid product (7).

As liquid product (7) enters into atmospheric open type storage tank (2) the breather bag (1) is drawn up and its space is occupied in tank (2) with liquid product (7) filling.

In this operation step, it can be noted that stored liquid product (7) is segregated from atmospheric air (8). As breather bag's membrane is in direct contact with stored liquid product (7) surface evaporation change of the liquid product (7) is avoided.

ATMOSPHERIC OPEN TYPE STORAGE TANK (2) HIGH LEVEL

When the storing tank high level line is reached by liquid product (7), feed through inlet nozzle (4) is stopped.

The FIG. 14 shows atmosheric open type storage tank (2) full charged with liquid product (7) up to high level line.

The breather bag (1) will float and draw up over stored liquid product (7) surface or it will be crushed into stored liquid product (7).

At this step it is observed that:

1st) The stored liquid product (7) is segregated from atmospheric air (8);

2nd) The stored liquid product (7) evaporation change is avoided;

3rd) Any extraneous objects that would get into an atmospheric open type storage tank (2) will be retained by breather bag (1) membrane.

ATMOSPHERIC OPEN TYPE STORAGE TANK EMPTYING OPERATION

The atmospheric open type storage tank (2) emptying operation by stored liquid product (7) withdrawal is done through outlet nozzle (5) with its block valve in open position.

The FIG. 15 shows atmospheric open type storage tank (2) emptying operation by stored liquid product (7) through outlet nozzle (5).

During stored liquid product (7) withdrawal operation the breather bag (1) will adjust tightly to tank (2) inner wall and physical separation from stored liquid product (7) is maintained.

ATMOSPHERIC OPEN TYPE STORAGE TANK (2) LOW LEVEL

When atmospheric open type storage tank (2) low level line is reached by liquid product (7), withdrawal operation is stopped and tank's liquid product stored portion will be segregated from atmospheric air (8) by breather bag (1) membrane.

The FIG. 16 shows atmospheric open type storage tank (2) with stored liquid product (7) at low level line.

What is claimed is:

1. A device for storing, filling and emptying liquid products under atmospheric pressure while avoiding exposure of the liquid products to atmosphere, the device comprising:

a storage tank having a top containing a single opening, and a breather bag disposed inside said storage tank and having an open end air-tightly sealed around said single opening in said top, said open end being exposed to atmospheric air so that atmospheric air can enter into said breather bag via said open end but cannot enter through said single opening into said tank between said breather bag and storage tank, said storage tank having a liquid product inlet and a fluid outlet, said inlet and outlet being disposed in said tank on a side of said breather bag opposite said open end, said breather bag being made of an impermeable and flexible membrane constructed and arranged to be of a size corresponding to internal dimensions of said storage tank to fill the tank completely, said membrane having a wall thickness so as to support one of a positive pressure and a vacuum of negligible magnitude, said membrane having a minimal resistance to mechanical deformations and being chemically corrosion resistant to a liquid product stored in said tank, said breather bag being constructed and arranged within said tank so that a configuration of said bag may change in response to a change in an amount of liquid product disposed between said bag and an interior of said tank as caused by fluid flow via one of said liquid product inlet and fluid outlet, said bag being operative to prevent the liquid product from exposure to the atmosphere.

2. The device according to claim 1 wherein said storage tank is of a closed type and said top includes a neck containing said single opening which is an air vent.

3. The device according to claim 2, wherein said bag is constructed and arranged to be introduced into said tank through said air vent and to be inflated by blowing air through said single opening while purging initial air from between said tank and said breather bag.

4. The device according to claim 2 wherein said bag has a bottom portion secured only at a point to a bottom part of said tank.

5. The device according to claim 1 wherein said bag has a bottom portion secured only at a point to a bottom part of said tank.

6. A device for storing, filling and emptying liquid products under atmospheric pressure while avoiding exposure of the liquid products to the atmosphere, the device comprising:

a closed type storage tank having a top containing a plurality of air vents, and a corresponding plurality of breather bags disposed inside said storage tank, each breather bag having an open end air-tightly sealed around a respective one of said air vents, each said open end being exposed to atmospheric air so that atmospheric air can enter into the respective one of said breather bags via the respective open end but cannot enter through any one of said air vents into said tank between any of said breather bags and storage tank, said storage tank having side and bottom walls one of which contains a liquid product inlet and one of which contains a fluid outlet, each said breather bag being made of an impermeable and flexible membrane having a wall thickness so as to support one of a positive pressure and a vacuum of negligible magnitude, having a minimal resistance to mechanical deformations and being chemically corrosion resistant to a liquid product stored in said tank, said breather bags being constructed and arranged to correspond together to internal dimensions of said tank and to change in configuration in response to a change in the amount of liquid product disposed between said breather bags and an interior of said tank as caused by fluid flow via one of said liquid product inlet and said fluid outlet, and said breather bags being operative to prevent the liquid product from exposure to the atmosphere.

* * * * *